United States Patent [19]

Fujii et al.

[11] Patent Number: 4,747,754

[45] Date of Patent: May 31, 1988

[54] VARIABLE DISPLACEMENT WOBBLE PLATE TYPE COMPRESSOR WITH SOLENOID-OPERATED WOBBLE ANGLE CONTROL UNIT

[75] Inventors: Toshiro Fujii; Akira Nakamoto; Shinichi Suzuki, all of Kariya, Japan

[73] Assignee: Kabushiki Kaisha Toyoda Jidoshokki Seisakusho, Aichi, Japan

[21] Appl. No.: 93,797

[22] Filed: Sep. 4, 1987

[30] Foreign Application Priority Data

Sep. 5, 1986 [JP] Japan ..... 61-210404

[51] Int. Cl.[4] ..... F04B 1/06; F04B 1/28

[52] U.S. Cl. ..... 417/222; 417/270

[58] Field of Search ..... 417/222, 270

[56] References Cited

U.S. PATENT DOCUMENTS 4,526,516 7/1985 Swain ..... 417/222

4,606,705 8/1986 Parekh ..... 417/222

FOREIGN PATENT DOCUMENTS 176798 3/1986 Japan ..... 417/222

197775 9/1986 Japan ..... 417/222

*Primary Examiner*—William L. Freeh

*Attorney, Agent, or Firm*—Burgess, Ryan & Wayne

[57] ABSTRACT

A variable wobble plate type compressor with a variable angle non-rotary wobble plate, having a suction chamber for a refrigerant before compression, a discharge chamber for a compressed refrigerant, compressing cylinder bores, pistons reciprocated by the wobble plate within the cylinder bores for compressing the refrigerant, a crankcase having a chamber to receive therein a drive and a wobble plate mechanism, connected to the pistons to cause the reciprocating motion of the pistons and capable of changing the wobble angle thereof, a first passageway closably opened so as to apply a high discharge gas pressure of the discharge chamber to the drive and wobble plate mechanism within the crankcase chamber, a solenoid valve for closing and opening the first passageway in response to a change in a cooling load, and a second passageway providing a fluid communication between the crankcase chamber and the suction chamber, a spool valve urged by a spring toward a first position opening the second passageway thereby permitting evacuation of a high pressure gas from the crankcase chamber to the suction chamber while the solenoid valve is closing the first passageway, and moved toward a second position closing the second passageway in association with the operation of the solenoid valve for opening the first passageway.

6 Claims, 3 Drawing Sheets

VARIABLE DISPLACEMENT WOBBLE PLATE TYPE COMPRESSOR WITH SOLENOID-OPERATED WOBBLE ANGLE CONTROL UNIT

BACKGROUND OF THE INVENTION

1. Field of the Invention

The present invention relates to a variable displacement wobble plate type compressor with a wobble angle control unit capable of automatically changing a compressor displacement in response to a change in a cooling load in an air-conditioning system in which the wobble plate type compressor is accommodated, and more particularly, relates to a solenoid-operated wobble angle control unit incorporated into a variable displacement wobble plate type compressor for promoting a smooth and quick change of wobble angle of a wobble plate in response to a signal indicating a change in a refrigerating load with respect to a predetermined load value.

2. Description of the Related Art

A variable displacement wobble plate type compressor employing a typical solenoid-operated valve for controlling wobble plate angularity is disclosed in U.S. Pat. No. 4,533,299 to Swain et al. In the compressor, the solenoid-operated valve is used for controlling the opening and closing of a passageway between a high pressure discharge chamber and a crankcase chamber in which a variable angle wobble plate mechanism to drive the reciprocating motion of compressor pistons is accommodated. When the passageway between the high pressure discharge chamber and the crankcase chamber is opened, a high pressure gas is permitted to flow from the discharge chamber into the crankcase chamber so that a rise in pressure within the crankcase chamber is caused and a small angularity of the wobble plate mechanism is achieved. On the other hand, in the disclosed compressor, the crankcase chamber is communicated with a low pressure suction chamber of the compressor by way of another passageway having an orifice permitting a blow-by gas leaking from compressor cylinder bores into the crankcase chamber to escape from the crankcase chamber into the suction chamber. However, due to provision of the orifice, the crankcase chamber is always communicated with the low pressure suction chamber. As a result, at the initial stage of the opening of the passageway between the high pressure discharge chamber and the crankcase chamber, a high pressure gas flowing from the discharge chamber to the crankcase chamber is apt to escape from the crankcase chamber toward the suction chamber, and accordingly, the high pressure gas is unable to contribute to a smooth and quick rise in the crankcase chamber pressure.

U.S. Pat. No. 4,586,874 to Hiraga et al discloses another variable displacement wobble plate type compressor employing a solenoid-operated valve mechanism for controlling the wobble plate angularity. The solenoid-operated valve mechanism of U.S. Pat. No. 4,586,874 is arranged so as to be capable of opening and closing a passageway between a crankcase chamber and a suction chamber of the compressor. That is, when the passageway is opened by the solenoid-operated valve mechanism, a decrease in pressure within the crankcase chamber is caused so that the angularity of the wobble plate can be increased. However, in the solenoid-operated valve mechanism for controlling the wobble plate angularity of U.S. Pat. No. 4,586,874, an increase in pressure of the crankcase chamber for the purpose of reducing the wobble plate angularity must rely on a blow-by gas leaking from compressor cylinders into the crankcase chamber during the closing of the solenoid-operated valve plate. Accordingly, in the compressor of U.S. Pat. No. 4,586,874, a high discharge pressure gas is not used for increasing the crankcase chamber pressure. Thus, it is difficult to expect a smooth and quick change in the wobble plate angularity in response to a change in a cooling load.

An allowed U.S. patent application Ser. No. 019,476 filed on Feb. 26, 1986, now U.S. Pat. No. 4,702,677, with the same assignee as the present patent application discloses a further variable displacement wobble plate type compressor with a wobble angle return system for promoting a quick return of the wobble plate from the least wobble angle position to a larger wobble angle position. The wobble angle return system employs first and second mechanically operated valves, the first one being used for controlling fluid communication between a crankcase chamber and a discharge chamber of the compressor and the second one being used for controlling an extent of fluid communication between the crankcase chamber and a suction chamber of the compressor. However, the wobble angle return system of the allowed U.S. patent application does not teach complete association in the operation of the first and second valves. Moreover, the system is silent about the employment of a solenoid-operated valve means. Thus, the wobble angle return system of the allowed U.S. patent application Ser. No. 019,476 has a limitation in the rapidness of change in the wobble plate angularity.

SUMMARY OF THE INVENTION

An object of the present invention is, therefore, to provide a variable displacement wobble plate type compressor with a wobble angle control unit enabling a smooth and quick change in wobble plate angularity in response to a change in a cooling load.

Another object of the present invention is to provide a solenoid-operated wobble angle control unit for a variable displacement wobble plate type compressor which is capable of achieving a rapid rise in a pressure within a crankcase chamber depending on lowering of a cooling load of the compressor.

A further object of the present invention is to provide a solenoid-operated type wobble angle control unit for a variable displacement wobble plate type compressor which is provided with a single valve unit having a simple construction and formed by uniting a solenoid-operated plunger valve and a spool valve.

In accordance with the present invention, there is provided a variable displacement wobble plate type compressor for an air-conditioning system, which includes a housing element having therein a suction chamber for a refrigerant to be compressed and a discharge chamber for a compressed refrigerant, a cylinder block defining therein a plurality of cylinder bores in which associated reciprocatory pistons are disposed so as to draw the refrigerant from the suction chamber and then to discharge the refrigerant after compression to the discharge chamber, a closed crankcase defining therein a chamber for an assembly of wobble and drive plates to drive the reciprocatory pistons, and a control unit for changing an angle of wobble of the wobble plate in association with a change in a cooling load of the air-conditioning system, thereby changing a compressor displacement. The control unit comprises: a first passageway for fluidly communicating the crankcase chamber with the discharge chamber; a solenoid valve unit arranged in the first passageway for controlling the communication between the crankcase chamber and the discharge chamber in response to the change in the cooling load, the solenoid valve unit comprising a solenoid element capable of being energized and de-energized in response to a signal indicating the change in the cooling load and a movable plunger element magnetically moved by the solenoid between a first position thereof opening the first passageway and a second position thereof closing the first passageway; a second passageway for fluidly communicating the crankcase chamber with the suction chamber; a spring-biased spool valve unit arranged in the second passageway for controlling the communication between the crankcase chamber and the suction chamber, the spring-biased spool valve unit comprising a valve body element defining therein a part of the second passageway and a spool chamber, a spool element slidably received in the spool chamber and movable between a first position thereof opening the part of the second passageway and a second position thereof closing the part of the second passageway, and a first spring element received in one end of the spool chamber, for biasing the spool element toward the first position thereof, and unit for associating movement of the spool element of the spring-biased spool valve unit with movement of the plunger element of the solenoid valve unit.

BRIEF DESCRIPTION OF THE DRAWINGS

Other objects, features and advantages of the present invention will be made more apparent from the ensuing description of the embodiment of the present invention with reference to the accompanying drawings, wherein.

DESCRIPTION OF THE PREFERRED EMBODIMENT

The following description is provided for the case where the present invention is embodied by a variable displacement compressor with a solenoid-operated wobble angle control unit, used for air-conditioning a vehicle compartment or a car compartment. Thus, the compressor is driven by a car engine via an appropriate rotation transmitting mechanism, such as a conventional belt-pulley mechanism.

Figure 1:
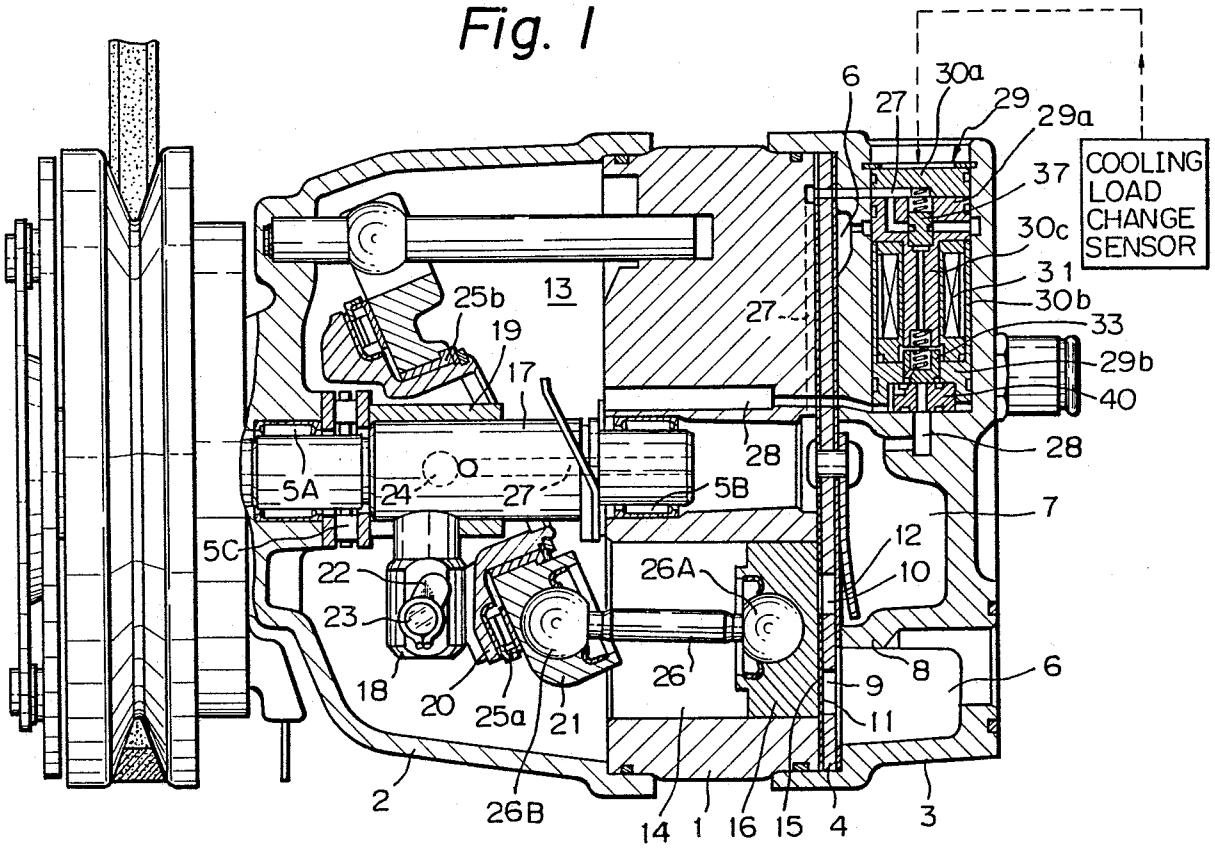
FIG. 1 is a vertical cross-sectional view of a variable displacement wobble plate type compressor with a solenoid-operated wobble angle control unit according to an embodiment of the present invention.
Figure 2:
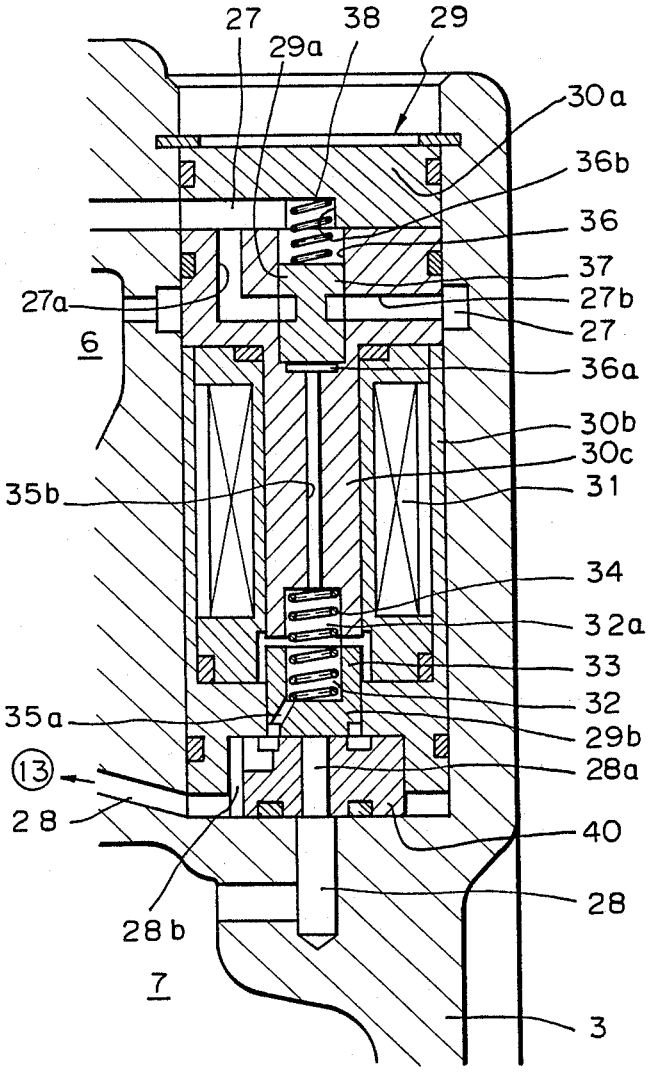
FIG. 2 is an enlarged cross-sectional view of the solenoid-operated wobble angle control unit accommodated in the compressor of FIG. 1 and illustrates a state where the solenoid-operated plunger valve is at a closed position.
Figure 3:
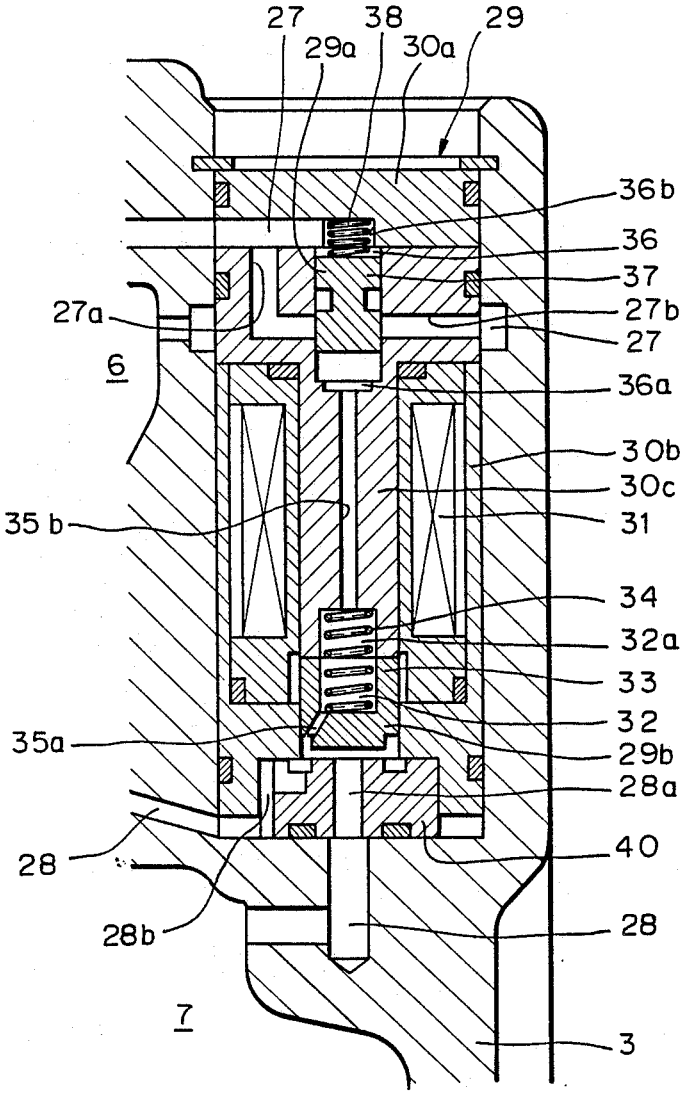
FIG. 3 is a similar view of FIG. 2, illustrating a state where the solenoid-operated plunger valve is at an open position.

Referring to FIGS. 1 through 3, a variable displacement wobble plate type compressor with a variable compression displacement includes a cylinder block 1, usually of cylindrical shape, having opposite open ends. One end of the cylinder block 1, i.e., the right open end in FIG. 1, is closed via a valve plate 4, by a rear housing or a head 3 having therein an outer suction chamber 6 annularly extending in the head 3 and an inner discharge chamber 7 separated from the outer suction chamber 6 by an annular partition wall 8. The other open end of the cylinder block 1, i.e., the left open end in FIG. 1, is closed by a front housing or crankcase 2 having therein a chamber 13 for receiving an assembly of a wobble plate mechanism described later. The crankcase 2 also has a centrally arranged bearing bore in which a rotary radial bearing 5A for rotatably supporting a drive shaft 17 is received. Further, a rotary thrust bearing 5C mounted on the drive shaft 17 for taking a thrust load is arranged adjacent to the rotary radial bearing 5A. Another rotary radial bearing 5B supporting the drive shaft 17 is received in a central portion of the cylinder block 1 coaxially with relation to the rotary radial bearing 5A. The suction chamber 6 of the rear housing 3 is communicated via suction ports 9 formed in the valve plate 4 with later-described compression chambers 15 of cylinder bores 14 of the cylinder block 1. The suction ports 9 of the valve plate 4 are opened and closed by suction valves 11, which open during the suction strokes of later-described pistons 16 and close during the compression strokes of the pistons 16.

The discharge chamber 7 of the rear housing 3 is communicated with the compression chambers 15 of the cylinder bores 14 via discharge ports 10 also formed in the valve plate 4 and provided with discharge valves 12 which open during the compression strokes of the pistons 16 and close during the suction strokes of the pistons 16.

The cylinder block 1 is formed with a plurality of axial cylinder bores 14 which are arranged in parallel with the drive shaft 17 equiangularly spaced apart from one another on a circle about the axis of the drive shaft 17. The axial cylinder bores 14 are all communicated with the chamber 13 of the crankcase 2. Each of the cylinder bores 14 is slidably fitted with a reciprocatory piston 16 which has a compressing face opposed to the valve plate 4, i.e., the right end face, defining the above-mentioned compression chamber 15 within the associated cylinder bore 14 so as to be communicatable alternately with the suction and discharge chambers 6 and 7. The piston 16 also has a rear face opposed to the crankcase chamber 13, i.e., the left end face, to which an end of a connecting rod 26 is connected via a ball and socket joint 26A, to a later-described wobble plate 21.

Within the crankcase chamber 13, the drive shaft 17 horizontally extends between the rotary radial bearings 5A and 5B, with a support pin 18 projecting radially from the drive shaft 17 and rotating with the drive shaft 17. On the support pin 18, a drive plate 20 in the form of an annular element surrounding the drive shaft 17 is supported so as to be rotatable with the drive shaft 17 and capable of wobbling about an axis perpendicular to the rotating axis of the drive shaft 17, i.e., toward and away from a plane vertical to the drive shaft 17. That is, the support pin 18 is formed with a curved guide slot 22 having a center of curvature selected so as to correspond to a center of each of the ball and socket joints 26A every time the support pin 18 comes into registration with one of the plurality of the cylinder bores 14. On the other hand, the drive plate 20 is provided with a guide pin 23 projecting into and engaging in the curved guide slot 22. Thus, when the drive shaft 17 is rotated by a vehicle engine, the drive plate 20 is rotated together with the drive shaft 17 via the engagement of the support pin 18 and the guide pin 23. Also, the drive plate 20 is made to wobble by the sliding of the guide pin 23 in the curved guide slot 22 under the guidance of the curved wall of the slot 22. Mounted on the drive shaft is a slidable sleeve element 19 connected to the drive plate 20 via a pair of laterally extending connecting pins 24. Thus, the sleeve element 19 axially slides along the drive shaft 17 in association with the wobble motion of the drive plate 20. The wobble plate 21, described previously, is non-rotatably supported on the drive plate 20 by means of a rotary thrust bearing 25a and a radial bearing 25b and is wobbled together with the drive plate 20. The wobble plate 21 in the form of an annular element surrounding a journal portion of the drive plate 20 and the drive shaft 17 is connected to each of the pistons 16 by the associated connecting rod 26 described before. The above-described drive shaft 17, the support pin 18, the drive plate 20, the wobble plate 21, and the connecting rods 26 constitute an assembly of a wobble plate mechanism for causing the reciprocatory movement of the pistons 16 in the cylinder bores 14.

A fluid passageway 27 extends from the suction chamber 6 of the rear housing or head 3 to the crankcase chamber 13 so as to provide a fluid communication between these two chambers 6 and 13. That is, the fluid passageway 27 is formed in the rear housing 3, the valve plate 4, the cylinder block 1, and the drive shaft 17.

Another fluid passageway 28 extends from the discharge chamber 7 of the rear housing 3 to the crankcase chamber 13 so as to provide a fluid communication between these discharge and crankcase chambers 7 and 13. That is, the fluid passageway 28 is formed in the rear housing 3, the valve plate 4, and the cylinder block 1.

In the above-described fluid passageways 27 and 28 is arranged a control valve unit 29 to control the respective fluid communications between the crankcase chamber 13 and the suction and discharge chambers 6 and 7, thereby controlling a pressure condition within the crankcase chamber 13. The control valve unit 29 is mounted in the rear housing 3 and has two different valves, one being a spring-biased spool valve 29a for controlling the opening and closing of the passageway 27 and the other being a solenoid-operated plunger valve 29b for controlling the opening and closing of the passageway 28. As described later, the spring-biased spool valve 29a is operated in association with the operation of the solenoid-operated plunger valve 29b. The control valve unit 29 has a spool valve body 30a and a plunger valve body 30b vertically assembled together within the rear housing 3. The spool valve body 30a has a vertical extension provided as a core portion 30c of the solenoid-operated plunger valve 29b. Around the core portion 30c is arranged a solenoid 31 capable of being energized and de-energized in response to a signal indicating a change in a cooling load from a low load condition to a large load condition and vice versa with regard to a predetermined cooling load condition. When the solenoid 31 is energized, an electromagnetic attraction appears on a lower end of the core portion 30c so as to move a cylindrical plunger 33 toward the lower end of the core portion 30c. When the solenoid 31 is de-energized, the electromagnetic force disappears, and accordingly, the plunger 33 is urged away from the core portion 30c toward a valve seat element 40 having a central port 28a by the force of a spring 34 received in a spring chamber 32a of the core portion 30c and a recess 32 of the plunger 33. The central port 28a of the valve seat element 40 is always communicated with the discharge chamber 7 of the rear housing 3 via a part of the fluid passageway 28. The valve seat element 40 also has a side port 28b which is always communicated with the crankcase chamber 13 via another part of the fluid passageway 28. When the plunger 33 is moved toward the end of the core portion 30c, the two ports 28a and 28b of the valve seat element 40 are fluidly communicated with one another so that the fluid communication between the discharge chamber 7 and the crankcase chamber 13 is established. When the plunger 33 is urged against the valve seat element 40, the fluid passageway 28 is closed, and accordingly, the fluid communication between the crankcase chamber 13 and the discharge chamber 7 is broken. The above-mentioned solenoid 31, core portion 30c, the plunger 33, the spring 34, and the valve seat element 40 constitute the solenoid-operated plunger valve 29b.

The plunger 33 of the solenoid-operated plunger valve 29b is provided with a fluid conduit 35a which always maintains communication between the port 28b of the valve seat element 40 and the recess 32 of the plunger 33 as well as the spring chamber 32a of the core portion 30c. The core portion 30c is provided with a vertical fluid conduit 35b extending from the spring chamber 32a to a later-described lower portion 36a of a spool chamber 36 of the spool valve 29a. Therefore, when the fluid passageway 28 is closed by the plunger 33 (FIG. 2), the above-described fluid conduits 35a and 35b communicate the above-mentioned lower portion 36a of the spool chamber 36 with the crankcase chamber 13 so that the pressure within the crankcase chamber 13 prevails in the lower portion 36a of the spool chamber 36. When the fluid passageway 28 is opened by the plunger 33 (FIG. 3), the fluid conduits 35a and 35b contribute to bringing a high discharge chamber pressure into the lower portion 36a of the spool valve chamber 36.

The spring-biased spool valve 29a has the afore-described valve body 30a, a slidable spool 37 having an annular groove at the middle portion thereof, and a biasing spring 38. The valve body 30a stationarily seated in the rear housing 3 is internally formed with a pair of fluid conduits 27a and 27b constituting a part of the fluid passageway 27. The valve body 30a is also internally formed with the afore-mentioned spool chamber 36 for the spool 37 and an upper spring chamber 36b for the biasing spring 38 to always urge the spool 37 toward the lower portion 36a. The upper spring chamber 36b is always communicated with the crankcase chamber 13 via a part of the fluid passageway 27.

As illustrated in FIG. 2, when the solenoid-operated plunger valve 29b closes the fluid passageway 28, the lower portion 36a and the upper spring chamber 36b of the spool chamber 36 are both communicated with the crankcase chamber 13. Accordingly, the spool 37 of the spring-biased spool valve 29a is moved by the biasing spring 38 toward the lowermost position thereof where the spool 37 establishes fluid communication between the suction chamber 6 and the crankcase chamber 13 via the annular groove of the spool 37, the fluid conduits 27a and 27b, and the passageway 27.

On the other hand, when the solenoid-operated plunger valve 29b opens the fluid passageway 28 as illustrated in FIG. 3, the high discharge chamber pressure prevails in the lower portion 36a of the spool chamber 36 of the spring-biased spool valve 29a. As a result, the spool 37 is moved up by the high discharge chamber pressure against the biasing spring 38, so that the spool 37 closes the fluid passageway 27, i.e., interrupts the fluid communication between the crankcase chamber 13 and the suction chamber 6.

From the foregoing description of the construction of the control valve 29, it will be understood that the spool valve 29a operates in association with the solenoid-operated plunger valve 29b. The spool 37 of the spool valve 29a may be provided with a lateral through-bore to communicate the fluid conduits 27a and 27b instead of the provision of the illustrated annular groove.

The operation of the variable displacement wobble plate type compressor according to the embodiment of the present invention will be described hereunder.

When the cooling load in the car compartment to be air-conditioned by the use of the variable displacement wobble plate type compressor of the present embodiment is larger than a predetermined value, the solenoid 31 of the solenoid-operated plunger valve 29b of the control valve 29 is brought into a de-energized state. Thus, the fluid passageway 28 is closed by the plunger 33 (FIG. 2). That is, the fluid communication between the discharge chamber 7 and the crankcase chamber 13 is broken. Therefore, the lower portion 36a of the pool chamber 36 of the spring-biased spool valve 29a is communicated with the crankcase chamber 13 via the passageway 28, 38b and the fluid conduits 35a and 35b. The upper spring chamber 36a of the spool chamber 36 of the spring-biased spool valve 29a is always communicated with the crankcase chamber 13. Accordingly, the spool 37 of the spring-biased spool valve 29a is urged by the spring 38 toward the lower portion 36a of the spool chamber 36 and opens the fluid passageway 27, i.e., the fluid communication between the crankcase chamber 13 and the suction chamber 6 is established. Thus, the pressure level within the crankcase chamber 13 is maintained to be equivalent to that of the suction chamber 6. That is, a blow-by gas leaking from the compression chambers 15 of the cylinder bores 14 into the crankcase chamber 13 is evacuated from the chamber 13 toward the suction chamber 6 via the open fluid passageway 27. While the pressure level within the crankcase chamber 13 is maintained substantially equal to that of the suction chamber 6, the pistons 16 are permitted to reciprocate within the cylinder bores 14 so that they move toward their bottom dead centers, respectively, during the suction strokes. That is, the drive and wobble plates 20 and 21 are wobbled by a large angularity with respect to a plane perpendicular to the axis of the drive shaft 17. This ensures that a large amount of piston stroke can be obtained on each piston 16. Therefore, the maximum compression displacement is acquired. While the compressor is operated with the large displacement, the air-conditioning system continues to cool the car compartment. Thus, the cooling load is gradually decreased until it approaches the predetermined cooling load value.

When the cooling load within the car compartment is less than the predetermined cooling load value, a signal is applied to the solenoid-operated plunger valve 29b, which indicates that the solenoid 31 is to be energized. When the solenoid 31 is energized, the plunger 33 is electromagnetically moved toward the core portion 30c of the solenoid-operated plunger valve 29b and opens the fluid passageway 28 as best illustrated in FIG. 3. Therefore, the crankcase chamber 13 is fluidly communicated with the discharge chamber 7 via the fluid passageway 28 and the ports 28a and 28b. Thus, a high pressure discharge gas is sent from the discharge chamber 7 into the crankcase chamber 13 thereby causing a rapid pressure rise within the crankcase chamber 13. Simultaneously, the high pressure discharge gas is also sent to the lower portion 36a of the spool chamber 36 of the spring-biased spool valve 29a via the port 28a and the fluid conduits 35a and 35b. The high pressure discharge gas acting on the lower end of the spool 37 of the spool valve 29a lifts the spool 37 while overcoming the spring force of the spring 38 and the pressure within the upper spring chamber 36b of the spool chamber 36. As a result, the fluid passageway 27 is closed by the spool 37. That is, the passageways 27a and 27b are disconnected by the spool 37. Thus, the fluid communication between the crankcase chamber 13 and the suction chamber 6 is broken. At this stage, it should be understood that the closing of the fluid passageway 27 occurs at substantially the same time of the opening of the fluid passageway 28 due to the operation of the spring-biased spool valve 29a in association with the operation of the solenoid-operated plunger valve 29b. Therefore, no leakage of gas from the crankcase chamber 13 toward the suction chamber 6 occurs. Accordingly, the pressure level within the crankcase chamber 13 is rapidly increased by the supply of the high pressure discharge gas from the discharge chamber 7. Therefore, when the pistons 16 carry out their suction strokes, the end face of each piston 16 opposed to the compression face thereof is subjected to a high pressure which is reliably higher than the suction pressure of the refrigerant. Thus, during the suction stroke of the respective pistons 16, the pistons 16 are prevented from being moved to their bottom dead centers, respectively. Consequently, the angle of the wobble of the drive and wobble plates 20 and 21 is limited to a smaller angle. Therefore, the stroke of the pistons 16 is decreased resulting in a reduction in the compression displacement of the compressor.

While the compressor is carrying out the small displacement operation, when the cooling load within the car compartment increases until it reaches to the predetermined cooling load value, a signal is applied to the solenoid-operated valve 29b of the control valve 29, so that the solenoid 31 is de-energized. As a result, the plunger 33 is moved back to the valve seat element 40 so as to close the fluid passageway 28. Thus, the fluid communication between the crankcase chamber 13 and the discharge chamber 7 is interrupted. As soon as the fluid passageway 28 is closed, the supply of the high pressure discharge gas from the discharge chamber 7 into the crankcase chamber 13 and the lower portion of the spool chamber 36 of the spring-biased spool valve 29a is stopped. Accordingly, the spool 37 of the spool valve 29a is immediately moved down by the spring 38 toward the lower portion 36a of the spool chamber 36, so that the fluid passageway 27 is opened. Consequently, the pressure level within the crankcase chamber 13 decreases until it becomes substantially equal to the suction pressure level. Thus, the large displacement operation of the compressor is obtained.

From the foregoing description of the embodiment of the present invention, it will be understood that according to the present invention, due to the provision of the solenoid-operated wobble angle control unit having a solenoid-operated plunger valve and the spring-biased spool valve operated in association with the plunger valve, the pressure level within the crankcase chamber of a variable displacement wobble plate type compressor can be quickly and smoothly increased or decreased in response to a change in a cooling load of the compressor. Therefore, the compressor displacement can be smoothly and quickly varied in response to the change in the cooling load.

We claim:

1. A variable displacement wobble plate type compressor for an air-conditioning system including a housing element having therein a suction chamber for a refrigerant to be compressed and a discharge chamber for a compressed refrigerant, a cylinder block defining therein a plurality of cylinder bores in which associated reciprocatory pistons are disposed so as to draw the refrigerant from the suction chamber and then to discharge the refrigerant after compression to the discharge chamber, a closed crankcase defining therein a chamber for an assembly of wobble and drive plates to drive the reciprocatory pistons, and a control means for changing an angle of wobble of the wobble plate in association with a change in a cooling load of the air-conditioning system, thereby changing a compressor displacement, wherein said control means comprises:

first passageway means for fluidly communicating said chamber of said crankcase with said discharge chamber of said housing element;

solenoid valve means arranged in said first passageway means for controlling the communication between said crankcase chamber and said discharge chamber in response to the change in the cooling load, said solenoid valve means including a solenoid element capable of being energized and de-energized in response to a signal indicating the change in the cooling load and a movable plunger element magnetically moved by said solenoid between a first position thereof opening said first passageway means and a second position thereof closing said first passageway means;

second passageway means for fluidly communicating said chamber of said crankcase with said suction chamber of said housing element;

spring-biased spool valve means arranged in said second passageway means for controlling the communication between said crankcase chamber and said suction chamber, said spring-biased spool valve means including a valve body element defining therein a part of said second passageway means and a spool chamber, a spool element slidably received in said spool chamber and movable between a first position thereof opening said part of said second passageway means and a second position thereof closing said part of said second passageway means, and a first spring element received in one end portion of said spool chamber, for biasing said spool element toward said first position; and means for associating movement of said spool element of said spring-biased spool valve means with movement of said plunger element of said solenoid valve means.

2. A variable displacement wobble plate type compressor according to claim 1, wherein said spool element of said spring-biased spool valve means has an annular groove at an intermediate portion thereof to open said part of said second passageway means when said spool element is moved to said first position thereof.

3. A variable displacement wobble plate type compressor according to claim 1, wherein said solenoid valve means comprises a stationary electromagnetic core element having one end toward and away from which said plunger element is magnetically moved by said solenoid and a second spring element arranged between said stationary electromagnetic core element and said plunger element for urging said plunger element toward said second position of said plunger element.

4. A variable displacement wobble plate type compressor according to claim 3, wherein said means for associating movement of said spool element of said spring-biased spool valve means comprises a third passageway means formed in said stationary electromagnetic core element and said plunger element of said solenoid valve means, said third passageway means applying a refrigerant pressure of said discharge chamber to said spool element so as to move said spool element toward said second position against said first spring element of said spring-biased spool valve means.

5. A variable displacement wobble plate type compressor according to claim 3, wherein said stationary electromagnetic core element of said solenoid valve means is integrally formed with said valve body element of said spring-biased spool valve means, so that said spring-biased spool valve means and said solenoid valve means are combined together so as to form a single valve unit.

6. A variable displacement wobble plate type compressor according to claim 5, wherein said single valve unit formed by the combination of said spring-biased spool valve means and said solenoid valve means is mounted in said housing element.

* * * * *